United States Patent [19]

Kandel

[11] 4,032,196

[45] June 28, 1977

[54] PROCESS FOR TREATING PILE MATERIALS MADE INTO ELECTROPHOTOGRAPHIC TONER REMOVAL BRUSHES

[76] Inventor: Thomas G. Kandel, 100 E. Hartsdale Ave., Hartsdale, N.Y. 10530

[22] Filed: Oct. 23, 1975

[21] Appl. No.: 625,050

[52] U.S. Cl. ..... 300/21

[51] Int. Cl.[2] ..... A46D 19/00

[58] Field of Search ..... 300/21; 29/120

[56] References Cited

UNITED STATES PATENTS

| | | | |
|---|---|---|---|
| 2,447,241 | 8/1948 | Englund | 300/21 X |
| 2,789,075 | 4/1957 | Stahl | 300/21 X |
| 2,806,803 | 9/1957 | Thackara et al. | 300/21 X |
| 3,295,893 | 1/1967 | Adams | 300/21 |
| 3,610,693 | 10/1971 | Solarek | 300/21 |

*Primary Examiner*—Granville Y. Custer, Jr.
*Attorney, Agent, or Firm*—Charles J. Speciale

[57] ABSTRACT

A process for treating a pile material which is ultimately to be made into a toner removal brush used in association with electrophotographic printing which comprises subjecting the pile substrate material to a water medium, withdrawing excess moisture by mechanical means and simultaneously orienting the pile, preferably allowing the wet material to dry at ambient or elevated temperature, forming an elongated pile-covered tubular structure with the resulting dried pile material, sizing the structure to desired lengths if necessary, subjecting the dried pile material to a further aqueous treatment, and then subjecting the pile-covered tube to a centrifugal force sufficient to hurl the pile fibers to an erect condition thereby forming a brush with superior toner removal properties.

11 Claims, 4 Drawing Figures

PROCESS FOR TREATING PILE MATERIALS MADE INTO ELECTROPHOTOGRAPHIC TONER REMOVAL BRUSHES

BACKGROUND OF THE INVENTION

1. Field of the Invention

This invention relates generally to toner removal systems in electrophotographic printing machines and specifically to a method for making a toner removal brush with improved properties.

2. Description of the Prior Art

By definition, electrophotographic printing comprises the steps of (1) charging a electrophotographic surface, e.g., of selenium, tellurium, palladium, with a static voltage of about 3,000 volts (2) shielding the selenium surface, such as a plate, with a light pervious layer carrying an opaque image that is to be recorded (3) exposing the combination to a light source that is directed through the shield to the electrophotographic surface photoreceptor, or drum or plate whereby all the parts of the surface not covered by the opaque image give up their charge (4) dusting (i.e., developing) the plate with carbon or other powder toner (the toner will adhere to the charged portions) and (5) transferring the toner image to paper through the application of an electrostatic field.

This it is well recognized that electrophotography or "dry printing" requires the application of a pigmented powder on to the surface of a charged plate (the photoconductor) in order to develop the latent electrostatic images thereon. Thus toner removal becomes quite important if one is to accomplish both the substantial removal of all the toner from the photoconductor drum and at the same time, protect the longevity of the photoconductor drum, as well as the life of the brush.

In the prior art for example, cleaning brushes or wipers are used in drycopying machines or duplicators where such wipers are in contact with the image transferring masters made out of or coated with photoconductive materials and such wipers or brushes attempt to serve the purpose of removing the residual latent image from the photoconductor without damaging or destroying the photoconductor itself. So far this has not been fully accomplished in the prior art and the brush fiber ends retain fused toner and or either become clogged with toner material after relatively few turns of the brush against the photoconductor (the brush develops the same charge as the photoconductor, such charge arcing over toner particles and fusing the toner); or the brushes are made such that they scar and damage the photoconductor drum. Representative U.S. patents in the art of xerography and toner removal, just to name a few, include Nos. 2,297,691; 2,859,673; 2,911,330; 2,944,147; 2,959,153; and 3,093,039.

SUMMARY OF THE INVENTION

It is therefore among the principal objectives of this invention to provide a toner removal brush having a tremendously increased longevity in terms of the number of images produced by the copier before the brush becomes unusable and must be replaced and just as importantly, to provide a toner removal brush of improved properties such that it will not scratch or prematurely erode the sensitive surface of the photoconductor.

In accordance with the present invention, there is now provided a process for making a brush which will have these properties aforementioned which comprises subjecting a pile substrate material, which has been previously cut into elongated strips and back coated, e.g., latex, to a water medium, withdrawing excess moisture in the strips by a suction force, if desired, and preferably allowing the still wet strips to dry at ambient or elevated temperature, then winding the dried strips around a tubular core coated with an adhesive to form a pile covered tubular structure, sizing the structure to desired lengths if necessary, rewetting the nap on the core, and finally subjecting the wet pile on the core to a centrifugal force, it can be external or internal, which resultingly hurls the nap to an erect condition away from the core to form a tubular brush, controllably at right angles (it can be at another angle, if necessary) to the core. The drying step above can be omitted, but it is critical to the invention that the strip be wet when subjected to centrifugal force. Liquids other than water can be used such as methanol, methylethyl ketone, acetone, to name a few, but because of their high flammability, these are impractical and thus less preferable.

My copending application filed concurrently herewith entitled ELECTROPHOTOGRAPHIC TONER REMOVAL BRUSH AND METHOD OF MAKING SAME Ser. No. 625,051 discloses a method of making yet another superior brush by an aqueous chemical treatment among other steps.

BRIEF DESCRIPTION OF THE DRAWINGS

The invention will be hereinafter more fully described with reference to the accompanying drawing in which.

DESCRIPTION OF THE PREFERRED EMBODIMENTS

Figure 1:
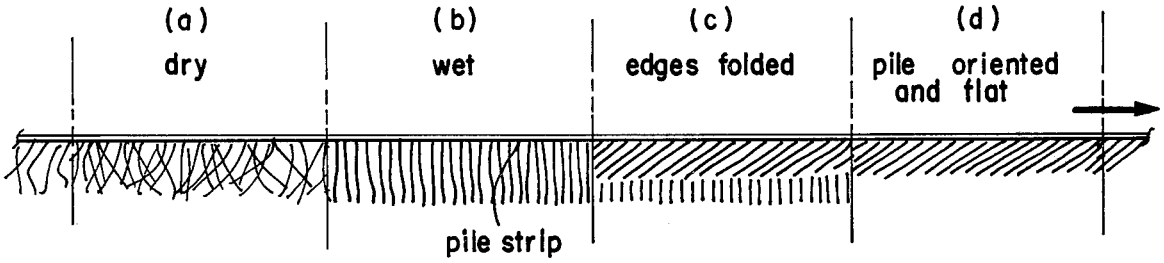
FIG. 1 shows diagrammatically the various stages of the pile material as it is treated according to the method of the invention.

Describing the process now in further detail, a natural or synthetic, preferably synthetic hollow filament, and preferably rayon, latex back coated pile substrate material is cut into elongated strips, e.g., about 15 to 30 yards in length and about 3¼ inches wide, but this is not critical and dimensions can vary. Each strip is then passed through a water bath, the water can also be sprayed on, thoroughly wetting it, and the strip is next passed over a source of suction such as a vacuum connected nap-folding fixture head, as described in my copending application filed concurrently herewith entitled COMBINATION NAP-FOLDING FIXTURE HEAD, Ser. No. 625,049. The purpose of the suction is two-fold. First, it removes loose pile and excess water from the strip, shortening ultimate drying time, and secondly, the pile nap is folded flat and oriented in one direction, and more importantly the fabric nap is edge-folded for a reason which will be subsequently described hereinbelow. While vacuum suction is the preferred method of edge-folding the fabric nap, it is to be understood that this step can also be accomplished by streams of air directed at the edges. It is also to be understood that the edges can be vacuumed while a rotating brush combs the nap unidirectionally simultaneously.

Preferably, next the strip is then dried at room temperature or slightly elevated. This step can be omitted according to another specific embodiment of the invention, as will be discussed hereinafter.

When the strip is dry it is applied to a tubular core (preferably cylindrical), e.g., Kraft lined cardboard, by butt winding (edge to edge) or gap winding, or overlap winding, preferably butt winding. This is a critical step in that the core should be covered in a predetermined pattern. It can now be seen why the edge-folding step is so important. By this step clean straight edges are obtained which will not be trapped in the winding seam. If the ragged edges were allowed to remain and become caught in the winding seam, the brush would not present a uniform nap and the seam windings would be visible through capillary seepage of the adhesive. Instead of winding strips a sleeve can also be made and fitted over the core. The sleeve or strip is bonded to the core by applying an adhesive to the core before or after fitting. As a precaution, a coloring agent is mixed in the adhesive, to contrast to the fabric color, whose purpose is to signal invasion of the adhesive to the brush which would have a serious deleterious effect on the uniformity of the brush nap and the adhesive would mar the photoconductor surface as well. Next, the adhesive is allowed to dry and following this, the pile covered core is cut to size. Of course, the cores can be pre-cut before pile covering. In the event, and this is preferable, the pile covered core is cut to size, it is important that it be cut at a 90° angle thereto and when cutting a vacuum force is applied in conjunction therewithto force the pile in an erect position. The angle of the cut and the vacuum associated therewith prevents the cutting across of fibers and partial loss of nap.

Thereafter, critically the pile on the core should be thoroughly wet, additionally wetting it as in the preferred embodiment wherein it was dried at ambient temperature, taking care not to wet the core ends, and taking care that preferably the pile remains oriented, i.e., as originally uni-directional. In this wet condition the nap is hurled to an erect condition, thereby forming a brush, by subjecting it to a centrifugal force which results from a high speed rotation of the brush, i.e., each strand thus being positioned to be perpendicular to the rotational axis of the core. In this case, the core is inserted over a rotatable spindle and the wet nap is touched to a high speed rotating texturing brush. Since the highest degree of erectness of the nap which can be accomplished is a function of the accelerating centrifugal forces exerted on the liquid which is moving through the strands making up the nap, therefore the higher the degree of the acceleration, the more prestressing of each strand is accomplished. Conversely, the core can be rotated at high speed in a plane perpendicular to the centrifugal hurling force. The centrifugal hurling time should be sufficient to bring the centrifugal force at the end of the nap to its full potential to bring the fibers erect, increase their density by collapsing the fiber walls via the escape of the liquid caused by the centrifugal force and resulting in the fibers having a pre-stressed state in the dry condition. Still further subsequent re-wetting and re-hurling of the nap, although not necessary, will result in more predictable product characteristics. After the centrifugal hurling thereby forming the final product the outside diameter of the brush can be sized by cutting to desired machine specifications and allowed to dry before use or preferably dried before sizing.

Table I hereinbelow summarizes the process steps of the invention showing the various embodiments of the invention method.

Figure 2:
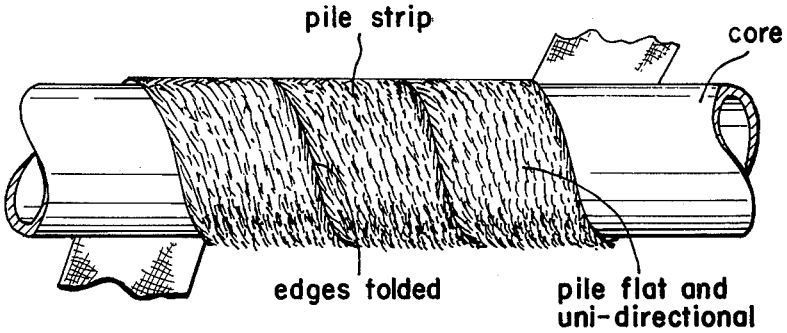
FIG. 2 shows a strip of the invention treated pile material in strip form as shown partially wound around a tube core.
Figure 3:
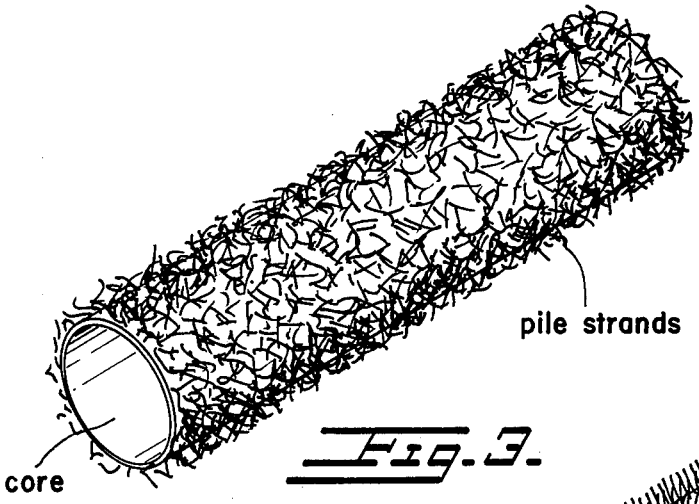
FIG. 3 shows in perspective a pile covered tube just before the centrifugal hurling treatment.
Figure 4:
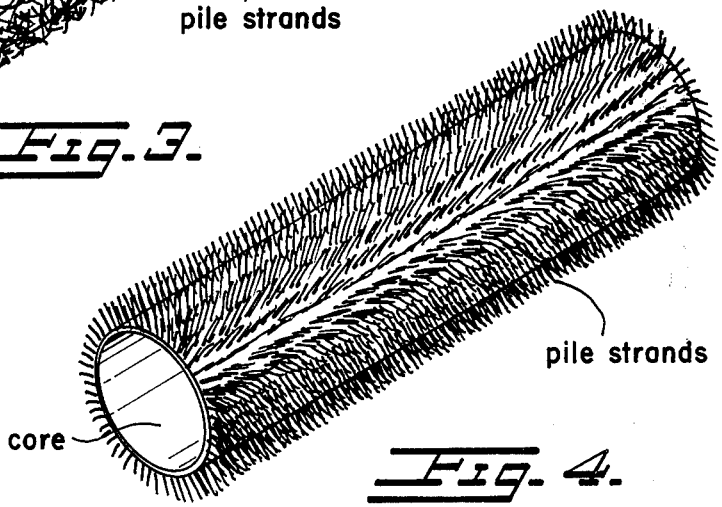
FIG. 4 shows in perspective the toner removal brush formed after centrifugal hurling.

Referring now to the figures of the drawing in terms of the method of invention just described hereinabove, there is shown in FIG. 1 a diagrammatic representation of a pile substrate strip at various stages of treatment: (a) the dry untreated substrate; (b) immediately after wetting; (c) edges folded by vacuum; (d) pile oriented unidirectionally and flat. FIG. 2 shows a fragment of a wet (or dry) strip butt-wound around a core; note edges are folded in and pile is flat and unidirectional. FIG. 3 shows the pile on the brush before centrifugal action i.e., before subjection of tubular core to centrifugal force and FIG. 4 shows the pile strands in an erect position after centrifugal hurling.

When employed in extant dry copying machines the toner removal brushes made by this invention show a remarkable longevity over the prior art brushes providing a cleaner system extending the service life of the system. The invention brushes are erect enough to clean more toner from the photoconductor yet softenough not to damage the photoconductor drum. The brushes also remain tone clog free for many, many reproductions by the drum reducing significantly the number of service changes of brush and drum, and providing more consistent copy quality.

TABLE I

| | STEPS | | | | | | | | |
|---|---|---|---|---|---|---|---|---|---|
| | 1 | 2 | 3 | 4 | 5 | 6 | 7 | 8 | 9 |
| Method | Substrate Wetting | Edging Orientation | Drying | Winding | Cutting | Wetting | Exploding | Drying | Sizing (O.D.) |
| A | Water | Yes (with or without vacuum) | Yes | Dry | Yes | Yes | Yes | Yes | Yes |
| B | Water | Yes | No | Wet | Yes | No | Yes | Yes | Yes |

What is claimed is:

1. A process for making an electrophotographic toner removal brush which comprises subjecting a pile substrate material to an aqueous medium, withdrawing excess moisture therefrom and simultaneously orienting the pile allowing the still wet material to dry, applying the resulting dried pile material to an elongated tubular base core forming an elongated pile-covered tube and subjecting said pile to a further aqueous treatment, and then finally subjecting said pile to a centrifugal force sufficient to hurl the pile fibers to an erect condition forming a brush nap wherein the density of each pile fiber has been increased by rapid centrifugal removal of the water therefrom and allowing the brush to dry.

2. A process according to claim 1 wherein said withdrawal of excess moisture and simultaneous orientation of the pile is accomplished by means of a suction force.

3. A process according to claim 1 wherein said pile substrate is in elongated strip form and is applied by adhesive bonding to said tubular core.

4. A process according to claim 1, wherein said pile substrate is in elongated strip form and said strip is applied by butt-winding around said tubular core.

5. A process according to claim 4 wherein said strip is applied by gap-winding.

6. A process according to claim 4 wherein said strip is applied by overlap-winding.

7. A process according to claim 4 wherein said pile-covered tube is sized by cutting at desired intervals at substantially right angles to the tube in simultaneous association with a vacuum force before said further aqueous treatment.

8. A process according to claim 4 wherein said strip is adhesively bondably applied to said tubular core.

9. A process for making electrophotographic toner removal brush which comprises subjecting an elongated strip of a pile substrate material to an aqueous medium, withdrawing excess moisture in said strip by means of a suction force so that the resulting pile is flat and uni-directional and its edges folded inwardly, then adhesively bondably applying the resultant wet strip around an elongated tubular core to form a pile-covered tube and exerting on said pile on said tube a centrifugal force sufficient to hurl the pile fibers to an erect condition thereby forming a brush nap wherein the density of each pile fiber has been increased by rapid centrifugal removal of the water therefrom, and allowing the brush to dry.

10. A process according to claim 9 wherein said adhesive is mixed with a coloring agent.

11. A process for making an electrophotographic toner removal brush which comprises subjecting a pile substrate material to a liquid medium, withdrawing excess liquid therefrom and simultaneously orienting the pile, allowing the still liquid wet material to dry, applying the resulting dried pile material to an elongated tubular base core forming an elongated pile-covered tube and subjecting said pile to a further liquid treatment, and then finally subjecting said pile to a centrifugal force sufficient to hurl the pile fibers to an erect condition forming a brush nap wherein the density of each pile fiber has been increased by rapid centrifugal removal of the liquid therefrom and allowing the brush to dry.

* * * * *